US009058941B2

(12) United States Patent
Malek et al.

(10) Patent No.: US 9,058,941 B2
(45) Date of Patent: Jun. 16, 2015

(54) FLOATING SWITCH ASSEMBLIES AND METHODS FOR MAKING THE SAME

(75) Inventors: Shayan Malek, San Jose, CA (US); Miguel C. Christophy, San Francisco, CA (US); Andriy Pletenetskyy, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 179 days.

(21) Appl. No.: 13/589,236

(22) Filed: Aug. 20, 2012

(65) Prior Publication Data

US 2014/0048400 A1 Feb. 20, 2014

(51) Int. Cl.

| | |
|---|---|
| ***H01H 1/10*** | (2006.01) |
| ***H01H 13/14*** | (2006.01) |
| ***H01H 13/20*** | (2006.01) |
| *H01H 1/58* | (2006.01) |

(52) U.S. Cl.

CPC ..... *H01H 13/14* (2013.01); *Y10T 29/49105* (2013.01); *H01H 13/20* (2013.01); *H01H 2001/5816* (2013.01); *H01H 2215/006* (2013.01); *H01H 2223/002* (2013.01); *H01H 2223/004* (2013.01); *H01H 2223/03* (2013.01); *H01H 2223/06* (2013.01)

(58) Field of Classification Search

CPC ..... H01H 11/00; H01H 13/06; H01H 13/705; H01H 13/86; H01H 1/10; H01H 2207/00; H01H 2215/036; H01H 2223/002; H01H 2229/044; H01H 2239/032; H01H 2239/038; H01H 9/02; H01H 2227/028; H01H 2227/036; H01H 2237/00; H01H 3/122; H05K 3/32; G06F 3/016; G06F 3/0202; G06F 1/169; B60K 2350/2008; B60Q 3/044; G02F 1/133617; G02F 13/04; G02F 13/20

USPC ..... 200/517, 520, 513, 515, 516, 314, 295, 200/293

See application file for complete search history.

(56) References Cited

U.S. PATENT DOCUMENTS

| | | | | |
|---|---|---|---|---|
| 5,152,392 | A * | 10/1992 | Iwasa | 200/517 |
| 5,475,192 | A * | 12/1995 | Inagaki et al. | 200/341 |
| 5,664,667 | A * | 9/1997 | Kenmochi | 200/314 |
| 6,710,276 | B2 * | 3/2004 | Miyashita | 200/406 |
| 2007/0246335 | A1 * | 10/2007 | Sharrah et al. | 200/1 B |
| 2008/0237009 | A1 * | 10/2008 | Weisz-Margulescu et al. | 200/302.1 |
| 2011/0000775 | A1 * | 1/2011 | Itou | 200/520 |

* cited by examiner

*Primary Examiner* — Kyung Lee

(74) *Attorney, Agent, or Firm* — Brownstein Hyatt Farber Schreck, LLP

(57) ABSTRACT

Switch assemblies that mitigate stack up variations and methods of making the same are provided. The stack up variations are mitigated by embodiments that use a floating switch design. The floating switch design may eliminate height variations in the stack up by directly mounting an activation assembly to a support bracket. This ensures that the stack up height of the activation assembly and support bracket remain fixed, independent of a flexible printed circuit board (PCB) that may also be secured to the activation assembly. This way, regardless of the thickness of the flexible PCB and any height variations in solder used to secure the flexible PCB to the activation assembly, the stack up height of the activation assembly and support bracket remains fixed.

23 Claims, 9 Drawing Sheets

FLOATING SWITCH ASSEMBLIES AND METHODS FOR MAKING THE SAME

BACKGROUND

This disclosure is directed to switch assemblies, and more particularly is directed to floating switch assemblies and methods for making the same.

Users can provide inputs to electronic devices (e.g., portable media players and cellular telephones) using many different approaches. Some known input components are conventional switch assemblies, which may include a stack up having a switch (e.g., a dome switch). As used herein, the term "stack up" is intended to refer to the layered components that form a switch assembly. Depending on design, a switch assembly stack up may contain several components. A conventional stack up of a switch assembly includes a dome switch having two leads that are soldered to a circuit board, and the circuit board is attached to a bracket. When the switch is pressed, an inner conductive surface of the switch contacts a contact pad on the circuit board to complete a circuit. The pressing of the switch can provide a tactile 'click' that enhances the user's interaction with the switch. In some cases, a cosmetic piece may be placed over the switch to form a button. In response to the user pressing the cosmetic piece, the switch is in turn depressed and contacts the contact pad thereby generating an input.

Conventional switch assemblies can suffer from a number of drawbacks that affect performance, assembly, and incorporation into an electronic device. These drawbacks can stem from variations in the stack up of the switch assembly. In particular, the stack up is susceptible to solder height variance, which can result in various height differences between the dome and the circuit board. In addition, height differences can also be realized in the circuit board/bracket interface (e.g., the thickness of the circuit board may vary). If the stack up height exceeds predetermined tolerances, then the switch assembly may not be able to fit within an electronic device it is designed to be used with, or the switch assembly may not function in its intended manner if it does not fit properly.

Accordingly, there is a need for improved switch assemblies that mitigate stack up variations.

SUMMARY

Switch assemblies that mitigate stack up variations and methods of making the same are provided. The stack up variations are mitigated by embodiments that use a floating switch design. The floating switch design may eliminate height variations in the stack up by directly mounting an activation assembly to a support bracket. This ensures that the stack up height of the activation assembly and support bracket remain fixed, independent of a flexible printed circuit board (PCB) that may also be secured to the activation assembly. This way, regardless of the thickness of the flexible PCB and any height variations in solder used to secure the flexible PCB to the activation assembly, the stack up height of the activation assembly and support bracket remains fixed. Thus, the flexible PCB floats relative to the activation assembly, and any variations in solder height will vary the height of the flexible PCB relative to the activation assembly, but have no effect on the overall height of the switch stack up.

According to a particular embodiment, a floating switch assembly includes a bracket, an activation assembly, and a flexible printed circuit board. The activation assembly is mounted on the bracket. The flexible printed circuit board is coupled to the activation assembly, and is operative to move, or float, relative to the activation assembly.

According to another particular embodiment a floating switch assembly includes a bracket, an activation assembly, a flexible printed circuit board, and a support member. The activation is fixed to the bracket. The flexible printed circuit board is coupled to the activation assembly, and is operative to float relative to the activation assembly. The support member is operative to support the flexible printed circuit board without interfering with the flotation of the flexible printed circuit board.

According to yet another embodiment, a method of forming a floating switch assembly having a bracket, an activation assembly, and a flexible printed circuit board is disclosed. The method includes placing the activation assembly on a surface of the bracket and coupling the flexible printed circuit board to the activation assembly such that the flexible printed circuit board is operative to float relative to the activation assembly.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

Floating switch assemblies and methods for making the same are described below with reference to FIGS. 1-9.

Figure 1A:
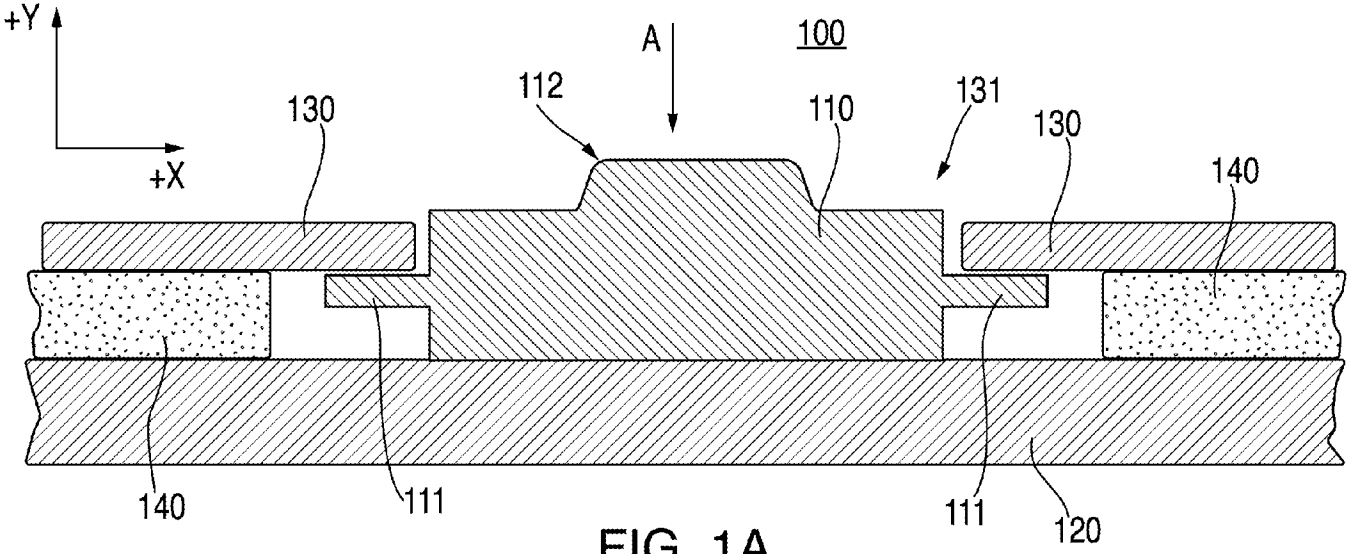
FIG. 1A shows a cross-sectional view of an illustrative floating switch assembly in accordance with an embodiment of the invention.
Figure 1B:
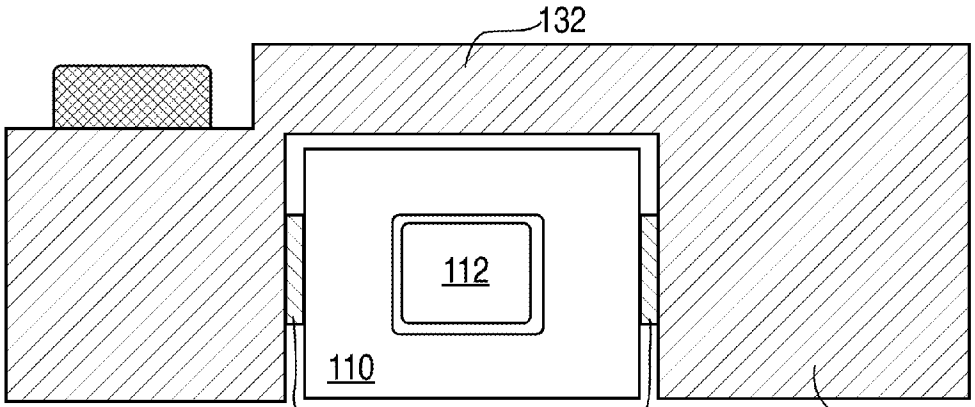
FIG. 1B shows a top view of the illustrative floating switch assembly of FIG. 1A in accordance with an embodiment of the invention.

FIGS. 1A and 1B show a cross-sectional and a top view, respectively, of floating switch assembly 100 in accordance with an embodiment of the invention. Floating switch assembly 100 may be included in an electronic device for providing user input to the electronic device. A user (not shown) can activate floating switch assembly 100 by exerting an activation force on activation assembly 110 in the direction of arrow A. This user activation force can depress or deform activation assembly 110 from an original position to an actuated position to change a functional state of the electronic device (e.g., whether the device should power up or turn off).

Floating switch assembly 100 may include activation assembly 110, bracket 120, flexible printed circuit board (PCB) 130, and support members 140. Activation assembly 110 may further include terminals 111 and actuator 112. Flexible PCB 130 may also include cutout 131. Activation assembly 110 is mounted directly to bracket 120 using any suitable approach (e.g., using an adhesive). Flexible PCB 130 is mounted directly to activation assembly 110 via terminals 111 and may be mounted to bracket 120 via support members 140.

Activation assembly 110 may be designed to house a suitable switch (e.g., actuator 112), and may be constructed from any suitable material (e.g., plastic). Terminals 111 may be integrated into activation assembly 110 and may protrude from the box-like region of activation assembly 110. Terminals 111 may be made from any suitable conductive material such as, for example, metal. Although activation assembly 110 is depicted as box shaped, it is understood that activation assembly 110 may have any suitable shape. Activation assembly 110 is operative to register switch events when a user presses down on actuator 112 in the direction of arrow A. Activation assembly 110 can convey information through terminals 111 via an electrical signal when a switch event occurs.

Bracket 120 serves as an anchor for activation assembly 110. For example, bracket 120 can support activation assembly 110 when the user presses on actuator 112. In this manner, bracket 120 may ensure that activation assembly 110 does not move or recede when force is applied to it. Bracket 120 may also provide support for other portions of floating switch assembly 100 (e.g., support members 140).

Flexible PCB 130 may include traces for relaying switch events to another component of an electronic device. For example, when switch events occur within activation assembly 110, flexible PCB 130 may relay the switch events to a processing unit (not shown) of the electronic device. Flexible PCB 130 may also include other components (not shown) of the electronic device. Flexible PCB 130 may fit around some or all of activation assembly 110. In order to properly fit around activation assembly 110, flexible PCB 130 may include cutout 131. Although cutout 131 is shown as a rectangular cutout, cutout 131 can be any shape needed to accommodate activation assembly 110. For example, cutout 131 may have a shape similar to activation assembly 110. More generally, one skilled in the art will appreciate that cutout 131 may have any suitable shape and dimensions to accommodate a floating switch design. Because flexible PCB 130 fits around activation assembly 110, it does not contribute to the overall stack up height of floating switch assembly 100.

Support members 140 may be positioned adjacent to activation assembly 110 and can couple flexible PCB 130 to bracket 120. Support members 140 may be constructed from a compliant material (e.g., foam, rubber, and/or plastic) that is operative to support flexible PCB 130 without hindering movement of flexible PCB 130.

The coupling interaction of activation assembly 110, bracket 120, and flexible PCB 130 enables PCB 130 to move, or float, relative to activation assembly 110. As used herein, the term "float" is intended to mean that an object is able to undergo fluid movement relative to another object. The fluid movement may include translational movement, rotational movement, or a combination thereof.

The floating aspect of switch assembly 100 is achieved, in part, based on the design of flexible PCB 130 and how it is coupled to bracket 120 and terminals 111. As shown in FIG. 1B, flexible PCB 130 may include cutout 131 dimensioned to fit around activation assembly 110, but is still able to be coupled to terminals 111. In other words, cutout 131 may provide enough clearance between activation assembly 110 and flexible PCB 130 so that flexible PCB 130 is operative to float relative to activation assembly 110 without being obstructed. In some embodiments, as shown in FIG. 1B, flexible PCB 130 may need to be connected as one singular element. In these embodiments, flexible PCB 130 may include bridge portion 132 to allow flexible PCB 130 to fit around activation assembly 110 as a single element. In other embodiments, two separate PCBs may be used in place of flexible PCB 130.

Terminals 111 may be coupled to flexible PCB 130 using any suitable approach, for example, via solder. Flexible PCB 130 may be coupled to terminals 111 such that the ability of flexible PCB 130 to float relative to activation assembly 110 is not hindered. In some embodiments, terminals 111 may be operative to flex or rotate in order to allow for increased movement of flexible PCB 130 relative to activation assembly 110. Flexing of terminals 111 may be about one axis of switch assembly 111 (e.g., about an axis out of the page of FIG. 1) while rotation of terminals 111 may be about another axis of activation assembly 110 (e.g., about the +X axis in FIG. 1). Support members 140 may be coupled to flexible PCB 130 and can support flexible PCB 130 without inhibiting its ability to float. Support members 140 can support flexible PCB 130 to prevent unnecessary stress on flexible PCB 130, terminals 111, and/or the coupling between them. Support members 140 are operative to support flexible PCB 130 without compromising its ability to move relative to activation assembly 110.

By incorporating a floating switch design, floating switch assembly 100 can mitigate stack up variations. Floating switch assembly 100 may eliminate height variations in its stack up because the stack up height of activation assembly 110 and bracket 120 remain fixed, independent of flexible PCB 130. This way, regardless of the thickness of flexible PCB 130 and any height variations in the coupling between flexible PCB 130 and terminals 111, the stack up height of activation assembly 110 and bracket 120 remains fixed. Thus, flexible PCB 130 floats relative to activation assembly 110, and any variations (e.g., in solder height) will vary the height of flexible PCB 130 relative to activation assembly 110, but have no effect on the overall height of floating switch assembly 100. As shown in FIG. 1, the stack up along the +Y axis for floating switch assembly 100 includes only activation assembly 110 and bracket 120. Flexible PCB 130 and terminals 111 do not contribute to the height of the stack up. Therefore, variations in flexible PCB 130 (e.g., the thickness and/or uniformity of flexible PCB 130) and the coupling between flexible PCB 130 and terminals 111 (e.g., the amount of solder between them) are not incorporated in the stack up. Reducing the variability of floating switch assembly 100 may result in better, more consistent button feel and improved assembly control of floating switch assembly 100. Additionally, removing flexible PCB 130 and terminals 111 from the stack up may allow for a reduced height (e.g., in +Y as shown in FIG. 1) of floating switch assembly 100 as compared to conventional switch assemblies.

In contrast, conventional switch assemblies are formed by soldering an activation assembly on top of a circuit board. The circuit board is then fixed to a bracket. In this manner, conventional switch assemblies include a circuit board in their stack up and add height to their stack up as a result. Additionally, any variations in the uniformity of the circuit board or in the coupling of the activation assembly and the circuit board affect the orientation of the activation assembly. As a result, undesirable variations may cause conventional switch assemblies to function improperly.

Figure 2A:
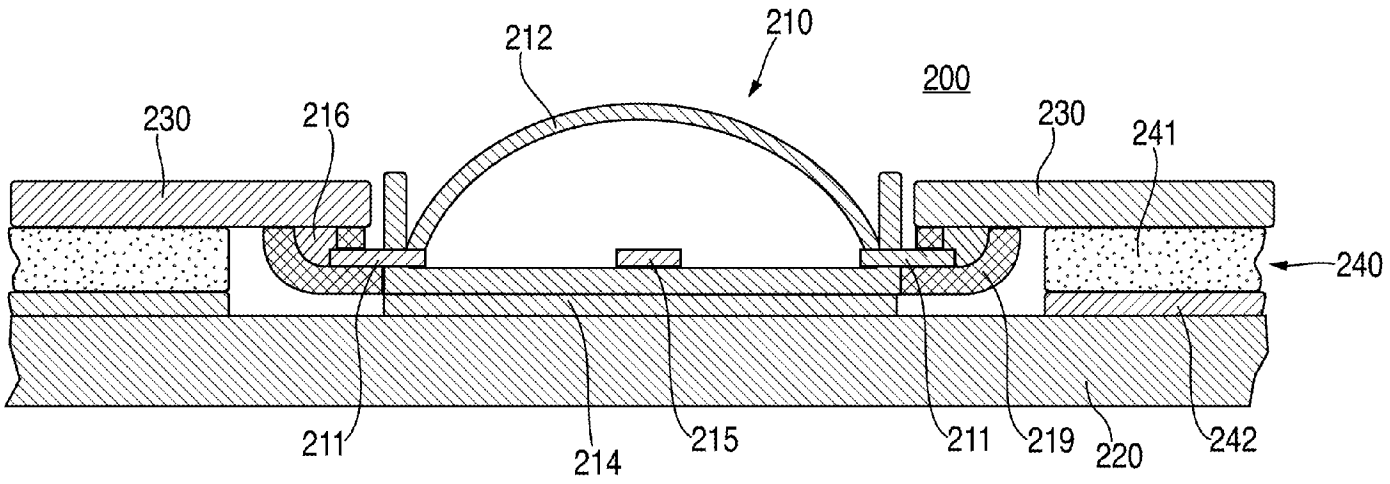
FIG. 2A shows a cross-sectional view of an illustrative floating switch assembly in accordance with an embodiment of the invention.
Figure 2B:
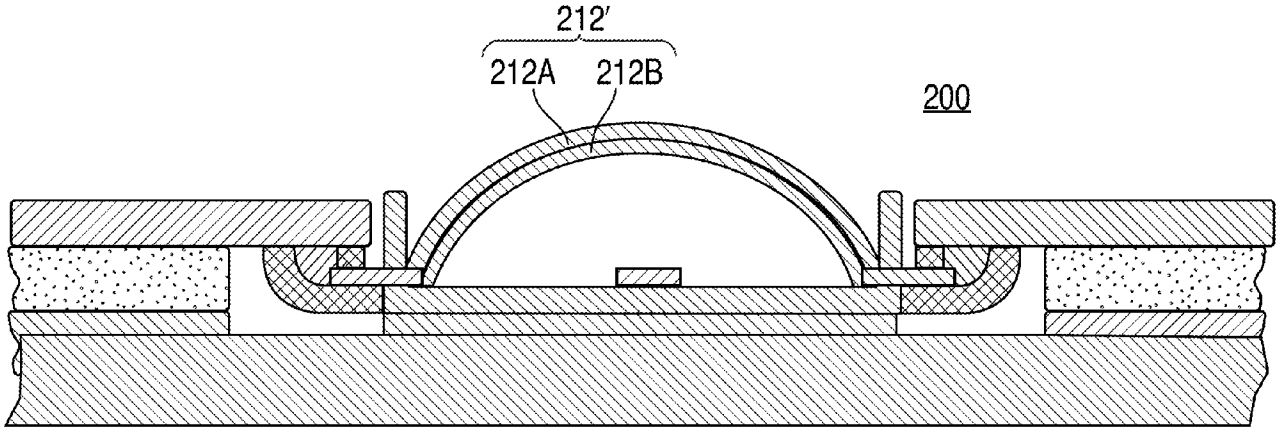
FIG. 2B shows a cross-sectional view of another illustrative floating switch assembly in accordance with an embodiment of the invention.

FIG. 2A shows a cross-sectional view of an illustrative floating switch assembly in accordance with an embodiment of the invention. Floating switch assembly 200 may be similar to floating switch assembly 100, and elements of FIG. 2A may have some or all features as similarly-numbered elements of FIG. 1. Floating switch assembly 200 may include activation assembly 210, bracket 220, flexible printed circuit board 230, and support members 240. Activation assembly 210 may further include terminals 211, switch 212, structural member 213, adhesive 214, contact pad 215, coupling joint 216, and insulating member 219.

Structural member 213 may be fixed to bracket 220 using adhesive 214. Structural element 213 may be constructed from a rigid material and can provide structural support to other elements of activation assembly 210. For example, structural element 213 may provide structural support to switch 212, terminals 211, or any other portion of activation assembly 210.

Terminals 211 may be coupled to flexible PCB 230 using coupling joint 216. Coupling joint 216 may electrically couple terminals 211 to flexible printed circuit board 230 using any suitable conductive material (e.g., solder). Coupling joint 216 may be constructed such that flexible printed circuit board 230 is operative to float relative to activation assembly 210.

Switch 212, depicted as a dome-shaped switch in FIG. 2A, may be electrically connected to each of terminals 211. Switch 212 may be operative to deform when actuated such that when the inner surface of switch 212 contacts pad 215, an electrical circuit connection is made between terminals 211. Although depicted as a dome-shaped switch in FIG. 2, in some embodiments, switch 212 may be a snap-acting pressure disc, a snap-acting force disc, a low profile tactile switch, or any other suitable type of switch. Switch 212 may be an elastically deformable switch. Switch 212 may be made of any suitable material, including, but not limited to, metal (e.g., stainless steel), plastic, or combinations thereof.

As shown in FIG. 2A, floating switch assembly 200 may include a single-component switch. For example, switch 212 includes a single dome. In other embodiments, a floating switch assembly may include a multi-component switch (e.g., two or more switches coupled to one another or two or more switches placed on top of one another in a stack). For example, referring briefly to FIG. 2B, stacked switch 212' may include two domes 212A and 212B in a stack. In some embodiments, dome 212A may be coupled to dome 212B using any suitable adhesive or glue therebetween.

Returning to FIG. 2A, insulating member 219 may be included in order to prevent terminals 211 from electrically shorting with another portion of floating switch assembly 200 (e.g., bracket 220). In addition, insulating member 219 may provide additional support to coupling joint 216. Insulating member 219 may be constructed from any suitable insulating material, including for example, an acrylic, an epoxy, a polyurethane, a silicone, Parylene, an amorphous fluoropolymer, or any other suitable material. Although shown as a separate component in FIG. 2A, in some embodiments, insulating member 219 may be integrated with activation assembly 210 (e.g., molded as part of structural member 213).

Support members 240 may be positioned adjacent to coupling joint 216 and can support flexible PCB 230 to prevent unnecessary strain on flexible printed circuit board 230, terminals 211, and/or coupling joint 216. Support members 240 may further include compliant members 241 and support member adhesives 242. Compliant members 241 may be fixed to bracket 220 using support member adhesives 242. Compliant members 241 may be constructed from a compliant material (e.g., foam, rubber, or plastic) that is operative to support flexible printed circuit board 230 without compromising its ability to move relative to activation assembly 210.

Figure 3A:
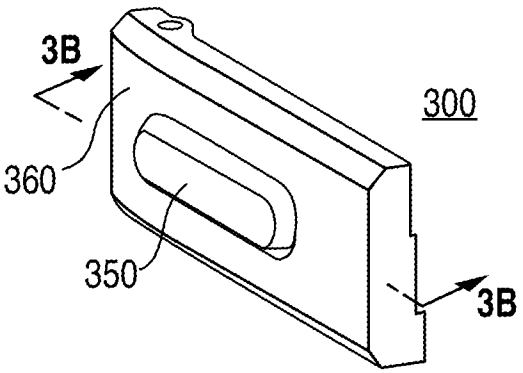
FIG. 3A shows a partial outside perspective view of an exemplary electronic device including an illustrative floating switch assembly in accordance with an embodiment of the invention.
Figure 3B:
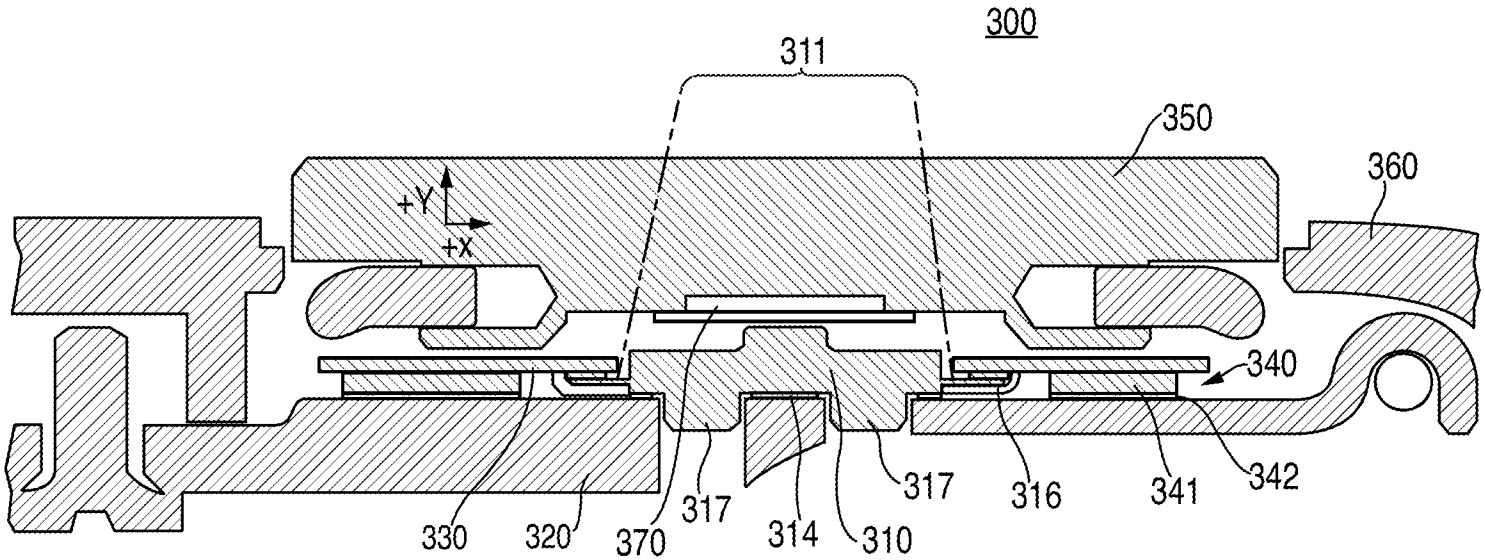
FIG. 3B shows a cross-sectional view of the electronic device of FIG. 3A, taken from line B-B of FIG. 3A, showing the floating switch assembly in accordance with an embodiment of the invention.
Figure 4A:
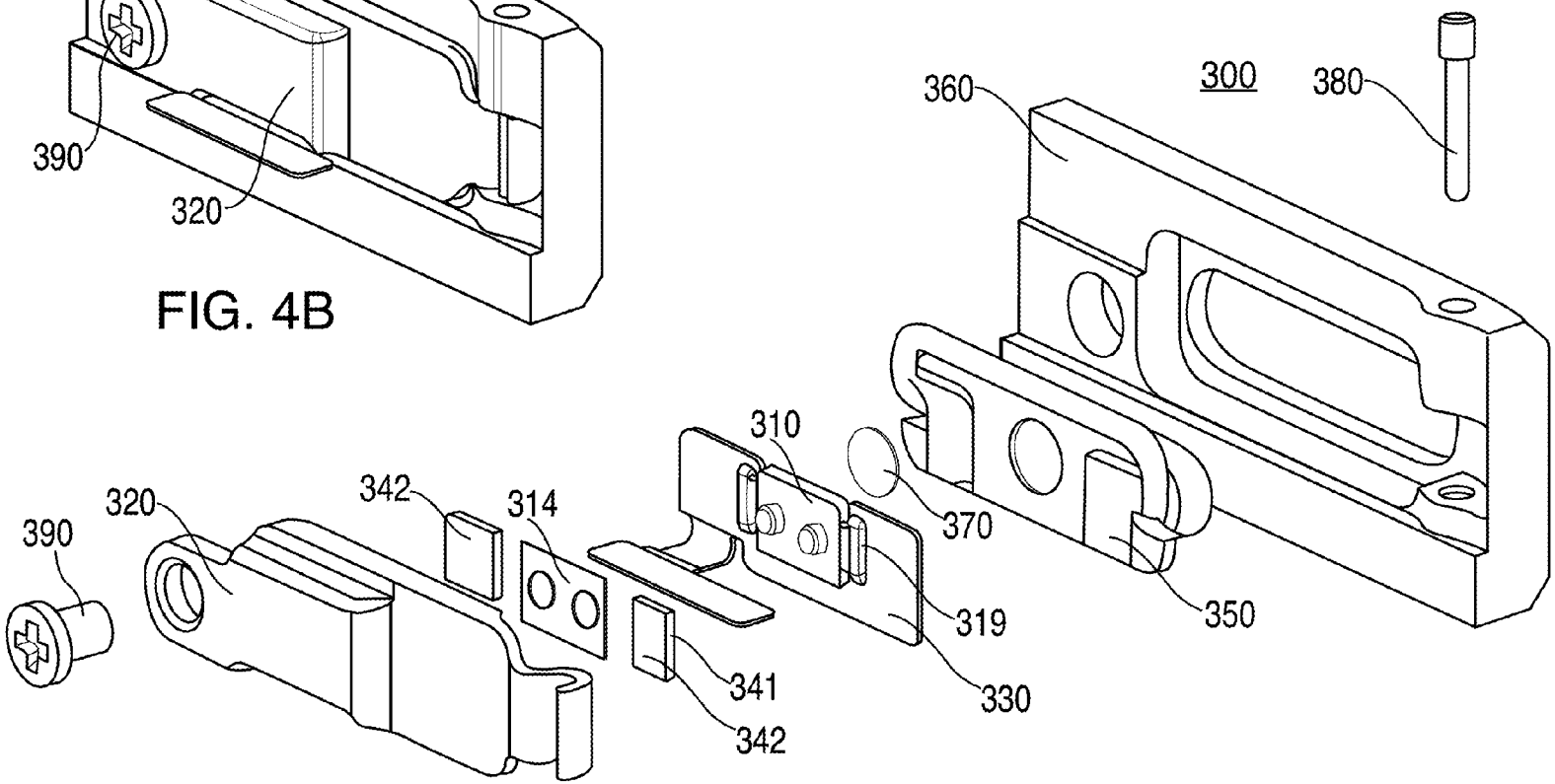
FIG. 4A shows an exploded view of the electronic device of FIG. 3A in accordance with an embodiment of the invention.
Figure 4B:
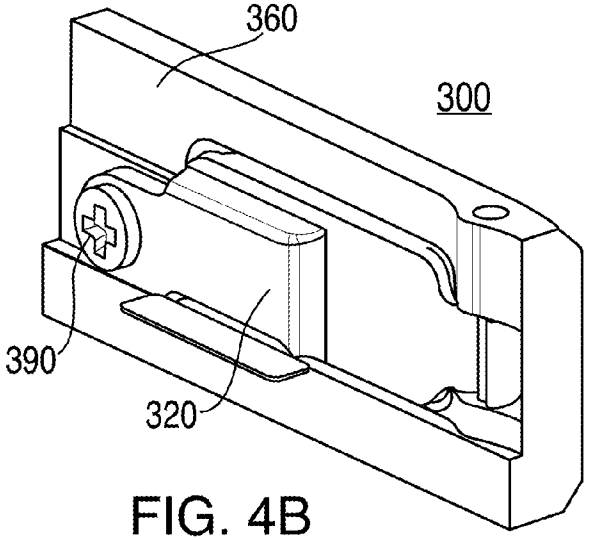
FIG. 4B shows a partial inside perspective view of the electronic device of FIG. 3A in accordance with an embodiment of the invention.

FIG. 3A shows a partial perspective view of electronic device 300 having a floating switch assembly in accordance with one embodiment of the invention. From the exterior, housing 360 and actuator 350 are visible to a user. FIG. 3B shows a cross-sectional view of the electronic device of FIG. 3A, taken from line B-B of FIG. 3A. FIG. 4A shows an exploded view of the electronic device of FIG. 3A and FIG. 4B shows a partial perspective view from inside the electronic device of FIG. 3A. The floating switch depicted as part of electronic device 300 may be similar to the floating switch assemblies shown in FIGS. 1 and 2, and as a result may share some or all features as similarly-numbered elements of FIGS. 1 and 2.

Referring to FIGS. 3A-3B and 4A-4B collectively, electronic device 300 may include switch assembly 310, bracket 320, flexible printed circuit board 330, and support member 340. Activation assembly 310 may further include terminals 311, switch assembly adhesive 314, coupling joint 316, alignment posts 317, and insulating member 319. A floating assembly may allow alignment pins or posts to be integrated into the switch body directly. For example, FIG. 3B shows floating switch assembly 300 with alignment posts 317 integrated into activation assembly 310 in accordance with one embodiment of the invention.

Activation assembly 310 may be fixed to bracket 320 using any suitable approach (e.g., using adhesive 314). In some embodiments, activation assembly 310 may include alignment posts 317 to engage bracket 320. Alignment posts 317 may secure activation assembly 310 to bracket 320 and may prevent activation assembly 310 from moving relative to bracket 320. Alignment posts 317 may be any suitable shape, including, but not limited to, cylindrical, spherical, ellipsoidal, hexahedral, tetrahedral, or combinations thereof. Bracket 320 may include a corresponding feature configured to receive alignment posts 317. In some embodiments, alignment posts 317 may include at least one feature (not shown) that secures structural member 313 to bracket 320 (e.g., a snap or a hook).

Electronic device 300 may also include a cosmetic actuator (e.g., actuator 350) positioned over activation assembly 310.

Actuator 350 is secured within housing 360 and forms an outer surface of electronic device 300. Actuator 350 may be made from any suitable material, including, but not limited to metal, rubber, plastic, or combinations thereof. Actuator 350 may provide an aesthetically pleasing outer surface of electronic device 300, and may also protect inner components of electronic device 300 from shock or other physical damage.

Shim 370 may be included between actuator 350 and activation assembly 310 to support actuator 350, adjust for a better fit between actuator 350 and activation assembly 310, and/or provide a level surface which actuator 350 may be seated on. Shim 370 may be constructed from any suitable material. For example, shim 370 may be constructed from metal, plastic, or any other suitable material.

Electronic device 300 may include bracket pin 380 and bracket screw 390 which secure bracket 320 to housing 360. Bracket pin 380 may be operative to be inserted into housing 360. When inserted in housing 360, bracket pin 380 may provide a hinge to which one end of bracket 320 may be attached. The other end of bracket 320 may be secured via bracket screw 390. Bracket screw 390 may be threaded into housing 360 and tightened to hold bracket 320 in place against housing 360.

As shown in FIG. 3B, flexible PCB 330, terminals 311, and coupling joint 316 are not included in the stack up in +Y. Removing these elements from the stack up allows for reduced height (e.g., in +Y) of the floating assembly, and also means that variations in any of these elements are not translated into the stack up. For example, variations in the thickness of flexible PCB 330 may be compensated for by deflection of compliant member 341 and/or terminals 311. As another example, variations in coupling joint 316 (e.g., the amount of solder between terminals 311 and flexible PCB 330) may be compensated for by movement of flexible PCB 330 and/or deflection of terminals 311. Thus, the position and orientation of activation assembly 310 relative to the other elements of electronic device 300 may be more consistent as compared to conventional switch assemblies. This results in better, more predictable button feel for floating switch assembly 300.

Figure 5:
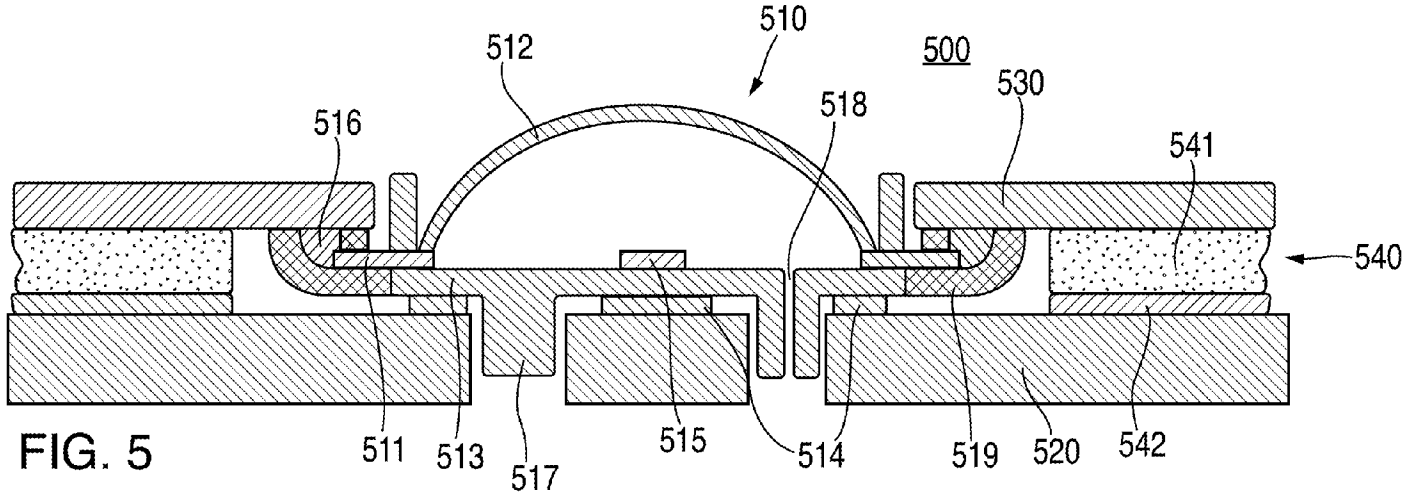
FIG. 5 shows a cross-sectional view of an illustrative floating switch assembly in accordance with an embodiment of the invention.

FIG. 5 shows a cross-sectional view of an illustrative floating switch assembly including a custom switch in accordance with an embodiment of the invention. As shown, vent hole 518 may be included in one of alignment posts 517, and as such, is integrated within structural member 513. Note that floating assembly 500 may also include other elements, such as switch assembly 510, bracket 520, flexible printed circuit board 530, support member 540, coupling joint 516, and insulating member 519, which may include some or all of the features disclosed in previous embodiments.

Switch 512 may be operative to deform when actuated such that the inner surface of switch 512 contacts contact pad 515 and provides a conductive path between terminals 511. The pressing of switch 512 may also provide a tactile 'click' that enhances a user's interaction with switch 512. When switch 512 is depressed, air from under switch 512 may travel through vent hole 518. Vent hole 518 may be any suitable size. In some cases, vent hole 518 may have a volume smaller than the internal volume of switch 512 while in other cases vent hole 518 may have a volume substantially the same as the internal volume of switch 512.

In some embodiments, vent hole 518 may be in fluid communication with an internal venting volume (not shown). In other embodiments, additional layers may be provided to further aid in forming the internal venting volume. For example, pockets may be formed with at least one film in fluid communication with the internal volume of switch 512.

Figure 6:
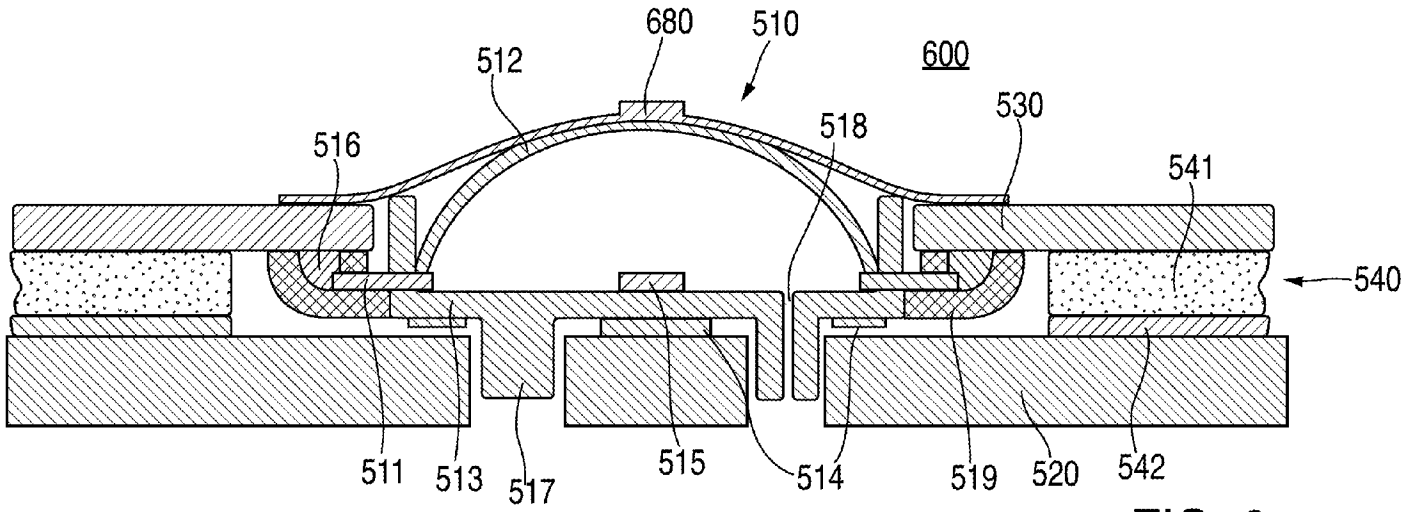
FIG. 6 shows a cross-sectional view of another illustrative floating switch assembly in accordance with an embodiment of the invention.

FIG. 6 shows a cross-sectional view of an illustrative floating switch assembly in accordance with an embodiment of the invention. Floating switch assembly 600 may be similar to floating switch assembly 500, and as a result may include some or all of the features disclosed with respect to FIG. 5. As shown in FIG. 6, sealing member 680 may be positioned over activation assembly 510 and extend over at least a portion of flexible PCB 530. Sealing member 680 may create an air tight seal that prevents liquid or any other debris from contaminating floating switch assembly 600. Sealing member 680 may be made of any suitable material (e.g., plastic). Additionally, a sealing member may be configured in a variety of ways. For example, sealing member 680 may be positioned only over structural member 513 and may not extend over flexible printed circuit board 530.

Figure 7A:
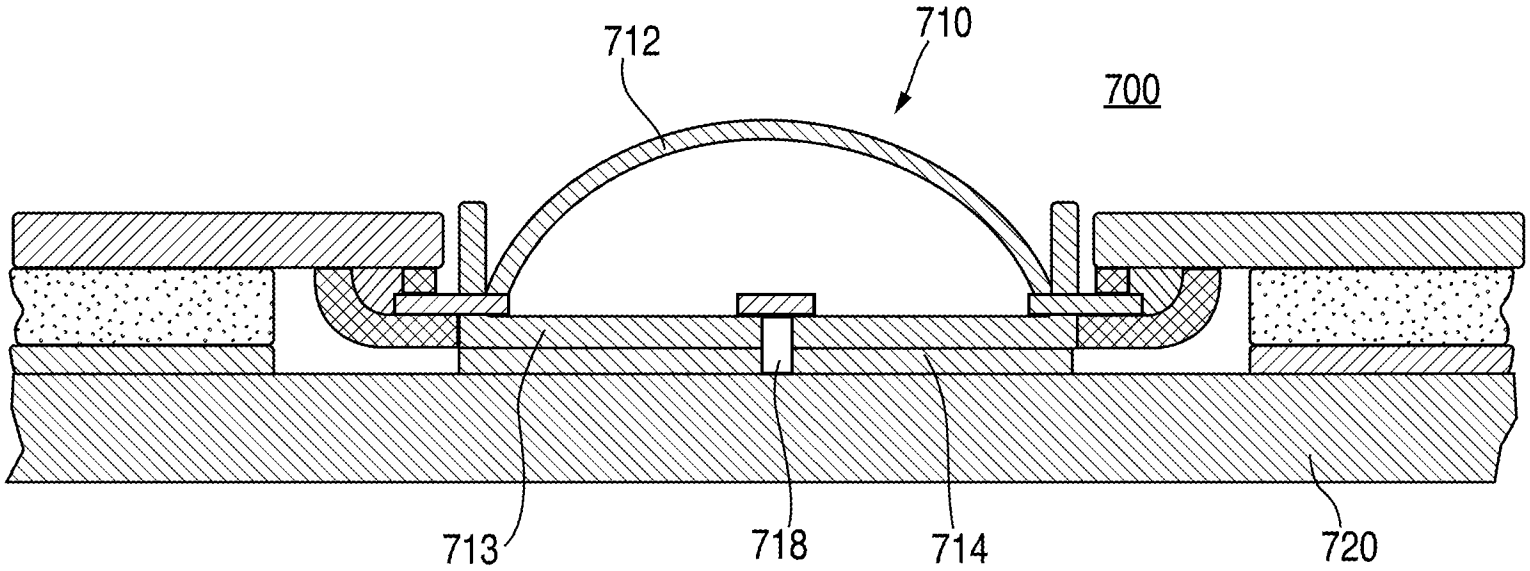
FIG. 7A shows a cross-sectional view of yet another illustrative floating switch assembly in accordance with an embodiment of the invention.
Figure 7B:
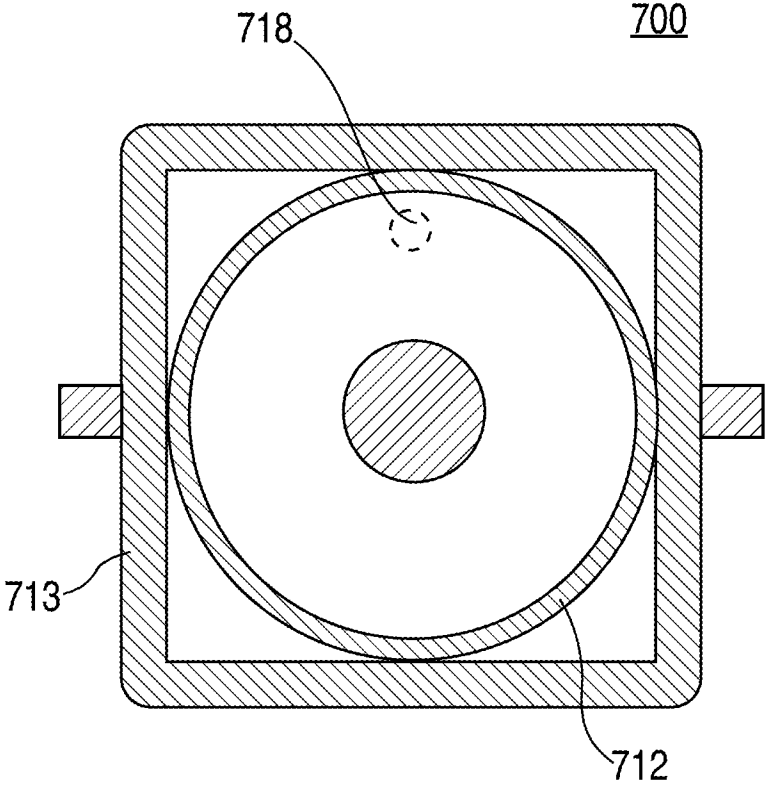
FIG. 7B shows a partial top cross-sectional view of the floating switch assembly of FIG. 7A in accordance with an embodiment of the invention.

FIG. 7A shows a cross-sectional view of an illustrative floating switch assembly in accordance with an embodiment of the invention. FIG. 7B shows a partial top cross-sectional view of the floating switch assembly of FIG. 7A. As shown in FIGS. 7A and 7B, in some embodiments that do not include alignment posts, a vent may be integrated in the switch assembly rather than in the alignment posts. For example, vent hole 718 may be included in structural member 713 and switch assembly adhesive 714. When switch 712 is depressed, air from under switch 712 may travel into vent hole 718 to relieve pressure build up on switch 712. Vent hole 718 may be any suitable size. In some cases, vent hole 718 may have a volume smaller than the internal volume of switch 712 while in other cases vent hole 718 may have a volume substantially the same as the internal volume of switch 712. In some embodiments, vent hole 718 may be in fluid communication with an internal venting volume (not shown). Although FIGS. 7A and 7B show an arbitrary positioning of vent hole 718, those skilled in the art will appreciate that the positioning of vent hole 718 may be modified without deviating from the spirit and scope of the invention.

Figure 8A:
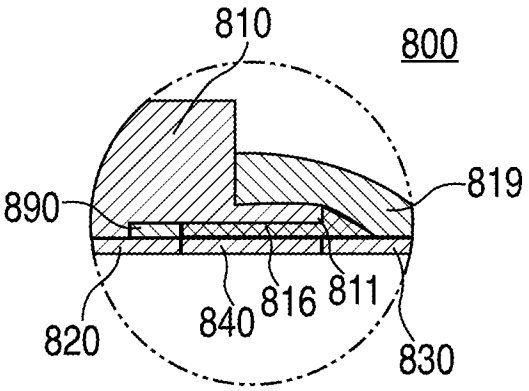
FIG. 8A shows a cross-sectional view of an illustrative floating switch assembly in accordance with an embodiment of the invention.
Figure 8B:
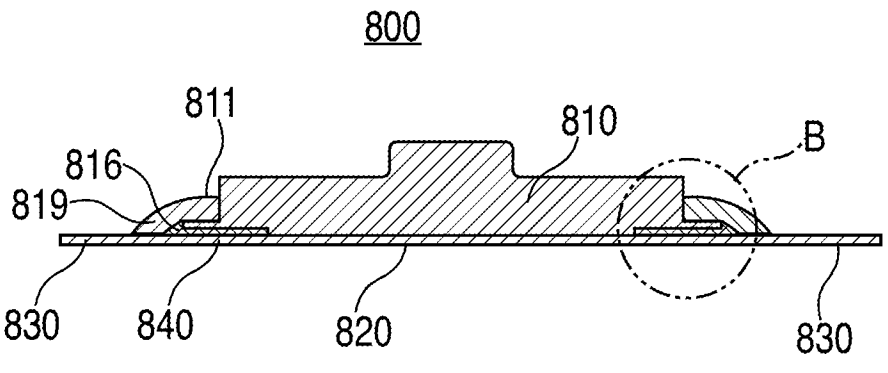
FIG. 8B shows a partial cross-sectional view of the floating switch assembly of FIG. 8A, showing a magnified view of section B from FIG. 8A in accordance with an embodiment of the invention.

FIG. 8A shows a cross-sectional view of an illustrative floating switch assembly in accordance with an embodiment of the invention. FIG. 8B shows a partial cross-sectional view of the floating switch assembly of FIG. 8A, showing a magnified view of section B from FIG. 8A. Those skilled in the art will appreciate that a floating switch assembly may be constructed in a variety of ways. For example, as shown in FIG. 8A, floating switch assembly 800 may have similar elements as other disclosed embodiments; however, the elements of floating switch assembly 800 have a different configuration with respect to one another (e.g., the placement of flexible PCB 830 is different). Floating switch assembly 800 may include activation assembly 810, bracket 820, flexible PCB 830, and support members 840. Activation assembly 810 may be attached to bracket 820 as shown in FIG. 8A. As seen in this embodiment, flexible PCB 830 may be in substantially the same plane as bracket 820 (as opposed to being positioned above bracket 820). Flexible PCB 830 may be coupled to terminals 811 by coupling joints 816 such that flexible PCB 830 is able to float relative to activation assembly 810. Support members 840 may be included beneath coupling joints 816 to prevent unnecessary stress on coupling joints 816, terminals 811, and/or flexible PCB 830. Support members 840 may be constructed from a compliant material (e.g., foam, rubber, or plastic) that is operative to support coupling joints 816 without compromising the ability of flexible PCB 830 to move relative to activation assembly 810.

FIG. 8B shows a magnified view of the coupling between activation assembly 810 and flexible PCB 830. As shown in FIG. 8B, floating switch assembly 800 may include insulating members 819 to prevent terminals 811 from electrically shorting with another portion of floating switch assembly 800. Insulating members 819 may also provide additional support to coupling joints 816. Floating switch assembly 800 may also include underfill 890 which may fill area under switch assembly 810 and help control the stress on coupling joints 816. Underfill 890 may be made from any suitable material, including, but not limited to, a specially engineered epoxy.

Figure 9:
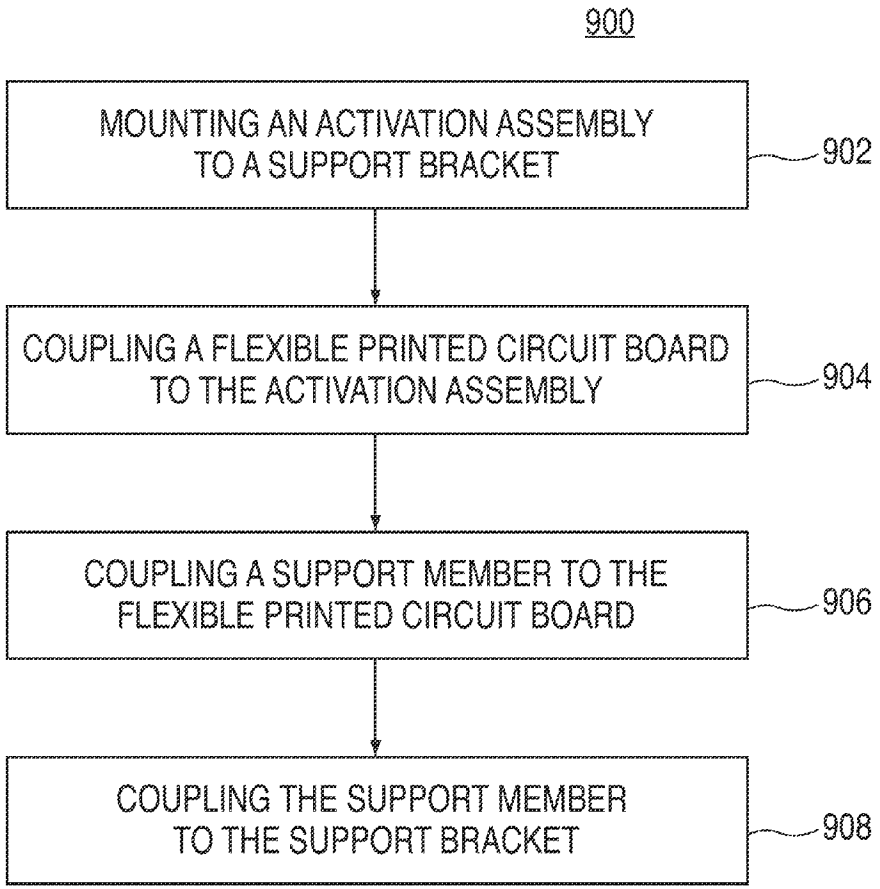
FIG. 9 shows an illustrative method for constructing a floating switch assembly in accordance with some embodiments of the invention.

FIG. 9 shows an illustrative method for constructing a floating switch assembly in accordance with some embodiments of the invention. Method 900 may begin at step 902. At step 902, an activation assembly may be mounted to a support bracket using any suitable process. For example, the activation assembly may be mounted to the support bracket using an adhesive. In some embodiments, the activation assembly and the support bracket may have corresponding features (e.g., alignment posts) that help fix the orientation of the activation assembly with respect to the support bracket. For illustrative purposes, the activation assembly and support bracket may be similar to activation assembly 310 and bracket 320 of FIG. 3. At step 904, a flexible PCB (e.g., similar to flexible PCB 330) may be coupled to the activation assembly. The activation assembly may include terminals that are specially designed to allow the flexible PCB to float relative to the activation assembly. Additionally, the flexible PCB may include a cutout to accommodate a portion of the activation assembly. The cutout may provide clearance for the flexible PCB to float properly without being obstructed. At step 906, a support member (e.g., similar to support members 340) may be coupled to the flexible PCB. The support member may support the flexible PCB without inhibiting its ability to float. At step 908, the support member may be coupled to the support bracket. The resulting configuration may look similar to the floating switch assembly of FIG. 3. Method 900 may then conclude at step 908. Although the method for constructing a floating switch assembly is presented using sequentially numbered steps, it is understood that the order of the steps may be altered without deviating from the scope of this disclosure.

As used herein, the term "electronic device" can include, but is not limited to, music players, video players, still image players, game players, other media players, music recorders, video recorders, cameras, other media recorders, radios, medical equipment, calculators, cellular telephones, other wireless communication devices, personal digital assistants, programmable remote controls, pagers, laptop computers, printers, or combinations thereof.

The previously described embodiments are presented for purposes of illustration and not of limitation. It is understood that one or more features of an embodiment can be combined with one or more features of another embodiment to provide systems and/or methods without deviating from the spirit and scope of the invention. It will also be understood that various directional and orientational terms are used herein only for convenience, and that no fixed or absolute directional or orientational limitations are intended by the use of these words. For example, the devices of this invention can have any desired orientation. If reoriented, different directional or orientational terms may need to be used in their description, but that will not alter their fundamental nature as within the scope and spirit of this invention. Those skilled in the art will appreciate that the invention can be practiced by other than the described embodiments, which are presented for purposes of illustration rather than of limitation, and the invention is limited only by the claims which follow.

What is claimed is:

1. An electronic device, comprising:

a bracket;

an activation assembly comprising:

a structural member fixed to the bracket;

a dome switch disposed on the structural member;

at least one terminal that extends away from an outer surface of the structural member; and a flexible printed circuit board that relays an electrical signal received from the at least one terminal when a switch event occurs, the flexible printed circuit board having a first side coupled to the bracket and to the at least one terminal.

2. The electronic device of claim 1, wherein the circuit board comprises a cutout to accommodate the structural member, such that the circuit board surrounds at least a portion of the structural member.

3. The electronic device of claim 1, wherein a first of the at least one terminal is electrically coupled to the dome switch.

4. The electronic device of claim 1, wherein the structural member further comprises at least one alignment post that engages the bracket.

5. The electronic device of claim 4, wherein a vent hole exists in one of the at least one alignment post.

6. The electronic device of claim 5, further comprising a sealing member disposed over the activation assembly and the flexible printed circuit board.

7. The electronic device of claim 1, further comprising a support member that couples the first side of the circuit board to the bracket.

8. The electronic device of claim 7, wherein the support member comprises a compliant material and adhesive.

9. The electronic device of claim 1, wherein a vent hole exists in the structural member.

10. An electronic device, comprising:

a housing forming an exterior surface of the electronic device, the housing comprising an aperture;

an actuator that protrudes through the aperture and extends beyond the exterior surface;

a bracket secured to an interior surface of the housing;

an activation assembly fixed to the bracket and the actuator, the activation assembly comprising a dome switch and at least two terminals; and a flexible printed circuit board that relays an electrical signal received from one of the at least two terminals when a dome switch event occurs, the flexible printed circuit board having a first side coupled to the bracket and the at least two terminals.

11. The electronic device of claim 10, further comprising a shim between the actuator and the activation assembly.

12. The electronic device of claim 10, further comprising a support member that couples the first side of the circuit board to the bracket.

13. The electronic device of claim 12, wherein the support member comprises a compliant material and adhesive.

14. The electronic device of claim 10, wherein the activation assembly further comprises at least one alignment post that engages the bracket.

15. A floating switch assembly, comprising:

a bracket; an activation assembly mounted directly on the bracket, the activation assembly comprising at least two terminals; and a flexible printed circuit board that relays an electrical signal received from one of the at least two terminals when an activation assembly event occurs, the flexible printed circuit board being coupled to the at least two terminals, wherein the flexible printed circuit board is operative to float relative to the activation assembly.

16. The floating switch assembly of claim 15, further comprising a support member fixed to the bracket and operative to support the flexible printed circuit board.

17. The floating switch assembly of claim 16, wherein the support member comprises a compliant material and adhesive.

18. The floating switch assembly of claim 15, wherein the activation assembly further comprises at least one alignment post that extends into the bracket.

19. The floating switch assembly of claim 15, further comprising a sealing member disposed over the activation assembly and the flexible printed circuit board.

20. The floating switch assembly of claim 15, wherein the flexible printed circuit board comprises a cutout to accommodate the switch assembly, such that the circuit board surrounds at least a portion of the activation assembly.

21. A method for creating a floating switch assembly, the method comprising:

mounting an activation assembly to a bracket;

coupling a flexible printed circuit board that relays an electrical signal received from the activation assembly when an activation assembly event occurs to the activation assembly by positioning a cutout of the flexible printed circuit board around at least a portion of the activation assembly;

coupling a support member to the flexible printed circuit board; and coupling the support member to the support bracket.

22. The method of claim 21, wherein mounting the activation assembly to the bracket comprises aligning an alignment post of the activation assembly with a corresponding feature of the bracket.

23. The method of claim 21, wherein the support member comprises a compliant material and adhesive.

* * * * *